US005657649A

United States Patent [19]

Lim

[11] Patent Number: 5,657,649

[45] Date of Patent: Aug. 19, 1997

[54] FULL-AUTOMATIC WASHING MACHINE HAVING A VIBRATION DAMPING ASSEMBLY

[75] Inventor: Hee Tae Lim, Incheon, Rep. of Korea

[73] Assignee: Daewoo Electronics Co., Ltd., Seoul, Rep. of Korea

[21] Appl. No.: 517,633

[22] Filed: Aug. 22, 1995

[30] Foreign Application Priority Data

Sep. 1, 1994 [KR] Rep. of Korea ..... 94-22025

[51] Int. Cl.[6] ..... D06F 37/24

[52] U.S. Cl. ..... 68/23.3; 248/613; 248/638

[58] Field of Search ..... 68/23.1, 23.3, 68/23.2, 23.5, 23.7; 34/58; 210/144; 494/82; 248/562, 638, 611, 613, 612

[56] References Cited

U.S. PATENT DOCUMENTS

| | | | |
|---|---|---|---|
| 1,873,834 | 7/1932 | Fleckenstein et al. | 248/613 |
| 2,275,050 | 3/1942 | Lewis | 248/611 |
| 2,981,089 | 4/1961 | Neyhouse et al. | 68/23.1 |
| 3,223,400 | 12/1965 | Deister, Jr. | 248/613 |
| 3,230,748 | 1/1966 | Jacobs | 68/23.1 |
| 3,296,839 | 1/1967 | Lornitzo | 68/32.1 |
| 3,703,091 | 11/1972 | Steele | 68/23.1 |
| 3,814,357 | 6/1974 | Rontgen | 248/638 |
| 4,713,714 | 12/1987 | Gatti et al. | 248/638 |
| 5,117,659 | 6/1922 | Sharp et al. | 248/638 |

FOREIGN PATENT DOCUMENTS

| | | | |
|---|---|---|---|
| 651505 | 9/1937 | Germany | 248/612 |
| 59-200835 | 11/1984 | Japan | 248/638 |
| 3-229035 | 10/1991 | Japan | 248/638 |
| 4-357345 | 12/1992 | Japan | 248/638 |

*Primary Examiner*—Frankie L. Stinson

*Attorney, Agent, or Firm*—Beveridge, DeGrandi, Weilacher & Young LLP

[57] ABSTRACT

A full-automatic washing machine which can effectively prevent an undesirable vibration is disclosed. The washing machine has a vibration damping assembly having a base plate formed integrally with a outer tub, a bended plate extended transversely above an end of the base plate, a bucket disposed below the base plate and formed integrally with the body of the washing machine, a first spring disposed between the end of the base plate and the bended plate, and a second spring elastically support the base plate. The washing machine disperses the vibration to the lower portion of the body of the washing machine so that the washing machine can stably carry out the washing and dehydration operations.

8 Claims, 3 Drawing Sheets

FULL-AUTOMATIC WASHING MACHINE HAVING A VIBRATION DAMPING ASSEMBLY

BACKGROUND OF THE INVENTION

1. Field of the Invention

The present invention relates to a full-automatic washing machine, and more particularly to a full-automatic washing machine having a vibration damping assembly which can effectively prevent an undesirable vibration 2. Prior Arts Generally, washing machines are classified into a full-automatic washing machine and a semi-automatic washing machine according to the operating manner.

As is well known, the full-automatic washing machine carries out washing, rinsing, and dehydrating operations about washing objects in a single spin tub so that there is no need to provide a separated dehydration tub for extracting a washing liquid contained in washed washing objects. On the contrary, the semi-automatic washing machine has a washing tub and a separated dehydration tub to carry out the washing and dehydrating operations, respectively.

Recently, the full-automatic washing machines are widely used as a household washing machine.

However, since the spin tub having relatively large volume is rotated at a high speed, the full-automatic washing machine generates a vibration while it carries out the washing and dehydrating operations.

In particular, when the washing objects are unevenly distributed within the spin tub, an extreme vibration may be created so that not only a loud noise is generated but also, in extreme case, the washing machine moves from its initial position.

To overcome the above mentioned problems, there has been effort to provide a full-automatic washing machine which can prevent an undesirable vibration thereof.

FIG. 3 shows such a conventional full-automatic washing machine 300 having an assembly 330 for damping a vibration.

As shown in FIG. 3, the conventional full-automatic washing machine comprises a body 305 having a plurality of projecting parts 307 formed in an upper portion of its inner wall, an outer tub 310 having a plurality of protuberances 312 formed in a lower portion of its outer wall, a spin tub 320 mounted in outer tub 310 so as to receive washing objects, a motor 340 for rotating spin tub 310, and a plurality of assemblies 330 for damping a vibration caused by rotation of spin tub 320.

Each of projecting parts 307 and protuberances 312 has a recess (not shown) for fitting vibration damping assembly 330.

Vibration damping assembly 330 includes a supporting member 332 fitted to the recess of projecting part 307 and formed with a perforated hole at a center thereof, a rod 334, one end of which is inserted in the perforated hole and the other end of which is fitted to the recess of protuberances 312, a housing 336 having an open end and disposed at an underside of protuberances 312 in order to damp a vibration of outer tub 310, and a cap 339 inserted into the open end of housing 336.

The conventional full-automatic washing machine 300 has four vibration damping assemblies 300.

The operation of the conventional full-automatic washing machine 300 being constructed as described above is as follows.

Firstly, in the event of a washing operation, when a user pushes an operating button (not shown) disposed in an upper portion of washing machine 300 on, a control unit (such as micro computer) generates a signal for washing operation, and thereby motor 340 is driven. The driving force of motor 340 is transmitted to pulsator 322 disposed in a lower portion of spin tub 320 so that pulsator 322 is rotated. As pulsator 322 rotates, a liquid flow having a swirl shape is generated in spin tub 320. The liquid flow that has been generated in spin tub 320 impacts on washing objects, which have been loaded in spin tub 320, and thereby the washing objects are washed.

Then, when the washing operation has finished, washing liquid that has been supplied to outer tub 310 is drained into an exterior of washing machine 300. In this state, the control unit generates a signal for dehydrating operation, and thereby motor 340 is driven again. At this time, the driving force of motor 340 is transmitted to spin tub 320 so that spin tub 320 is rotated.

As spin tub 320 rotates, the washing objects loaded in spin tub 320 are subjected to centrifugal force so that the washing objects are forced radially outward of spin tub 320, i.e., toward a side wall of spin tub 320, and thereby washing liquid contained in the washed washing objects is drained into an exterior of washing machine 300 through a plurality of openings formed in the side wall of spin tub 320.

During the washing and dehydrating operations, a vibration is inevitably happened in washing machine 300. In particular, the vibration may occur more extremely during the dehydration operation since spin tub 320 having a relatively large size is rotated at a high speed.

To reduce the vibration, conventional washing machine 300 comprises a plurality of vibration damping assemblies 330. Vibration damping assemblies 330 are regularly disposed around a circumference of outer tub 310 so as to effectively damp the vibration caused by high-speed rotation of spin tub 320.

That is, the vibration that has been generated by rotation of spin tub 320 or pulsator 322 is transmitted to housing 312 of vibration damping assembly 330, which is in contact with protuberance 312 of outer tub 310, through outer tub 310. At this time, spring 338 disposed in housing 312 is repeatedly compressed and expanded according to the vibration so that the vibration can be damped. The damped vibration is transmitted to support member 332 through rod 334 connected to housing 336 so that only a reduced vibration is transmitted to body 305 of washing machine 300.

However, the conventional automatic washing machine 300 being constructed as described above has the following disadvantages.

Firstly, vibration damping assembly 330 as mentioned above consists of a plurality of parts so that the construction of vibration damping assembly 330 is complex and assembling of vibration damping assembly 330 is difficult.

Further, when the washing objects are unevenly distributed within spin tub 320, a relatively heavier vibration is transmitted to an upper portion of body 305 of washing machine 300 so that a loud noise may happen.

Furthermore, a relatively larger space is needed in washing machine 300 to install vibration damping assembly 330.

Accordingly, there has been a necessity to provide an automatic washing machine having a vibration damping assembly which has a simple construction, which can effectively prevent the vibration, and which does not need a large installation space.

SUMMARY OF THE INVENTION

The present invention has been made to overcome the above described problems of the prior arts, and accordingly it is an object of the present invention to provide a full-automatic washing machine having a vibration damping assembly which has a simple construction, which can effectively prevent the vibration, and which does not need a large installation space.

To achieve the above object, the present invention provides a full-automatic washing machine comprising:

an outer tub for receiving supplied washing liquid;

a spin tub mounted in the outer tub so as to receive washing objects;

a motor for driving the spin tub; and a vibration damping assembly disposed in the vicinity of an underside of the outer tub for elastically supporting the outer tub, the vibration damping assembly damping a vibration caused by high-speed rotation of the spin tub and then dispersing the vibration to a lower portion of a body of the washing machine, the vibration damping assembly having a base plate formed integrally with the underside of the outer tub so as to receive a vibration from the outer tub, a bended plate extended transversely above an end of the base plate, a bucket disposed below the base plate and formed integrally with the body of the washing machine, a first spring disposed between the end of the base plate and the bended plate, a second spring disposed in the bucket so as to elastically support the base plate and a spring cap mounted to an upper portion of the second spring, the ends of the base plate being bended upwards at a predetermined distance so as to stably support the first spring, the bucket including a strip portion formed integrally with a lower portion of the body of the washing machine and a cylindrical body portion accommodating the second spring, an upper portion of the cylindrical body portion of the bucket being spaced out from the underside of the base plate at a predetermined distance so as to allow an elastic movement of the base plate, the bended plate having a stepped shape and including an upper portion disposed above the base plate and extended transversely so as to support the first spring, a lower portion contacted with the strip portion of the bucket and secured thereto by a bolt, and an upright portion disposed between the upper portion and the lower portion of the bended plate.

The full-automatic washing machine being constructed as described above according to the present invention is operated as follows.

Firstly, in the event of a washing operation, when a user pushes an operating button disposed in an upper portion of the washing machine on, a control unit (such as micro computer) generates a signal for washing operation, and thereby the pulsator is rotated in a reciprocating motion. As the pulsator rotates, a liquid flow having a swirl shape is generated in the spin tub. The swirl shaped liquid flow that has been generated in the spin tub impacts on washing objects, and thereby the washing objects are washed.

Then, when the washing operation has finished, the control unit generates a signal for dehydrating operation, and thereby the spin tub is rotated.

As the spin tub rotates, the washing objects loaded in the spin tub are subjected to centrifugal force so that the washing objects are forced radially outward of the spin tub, and thereby washing liquid contained in the washed washing objects is drained into an exterior of the washing machine through a plurality of openings formed in the side wall of the spin tub.

During the washing and dehydrating operations, since the spin tub having a relatively large size is rotated at a high speed, a vibration is inevitably occurred in the washing machine.

To reduce the vibration, the vibration damping assembly is mounted in the vicinity of the underside of the outer tub.

The vibration damping assembly allows an elastic movement of the outer tub, and thereby the vibration can be reduced. The reduced vibration is transmitted to the lower portion of the body of the washing machine so that the washing machine may stably carry out the washing and dehydrating operations without making a shake of washing machine.

As mentioned above, the vibration damping assembly of the present invention has a simple construction so that it may be easily assembled into the washing machine, and effectively reduce the vibration of the washing machine.

BRIEF DESCRIPTION OF THE DRAWINGS

The above objects and other advantages of the present invention will become more apparent by describing in detail preferred embodiments thereof with reference to the attached drawings, in which.

DESCRIPTION OF THE PREFERRED EMBODIMENTS

Hereinafter, the present invention will be described in detail with reference to the accompanying drawings.

Figure 1:
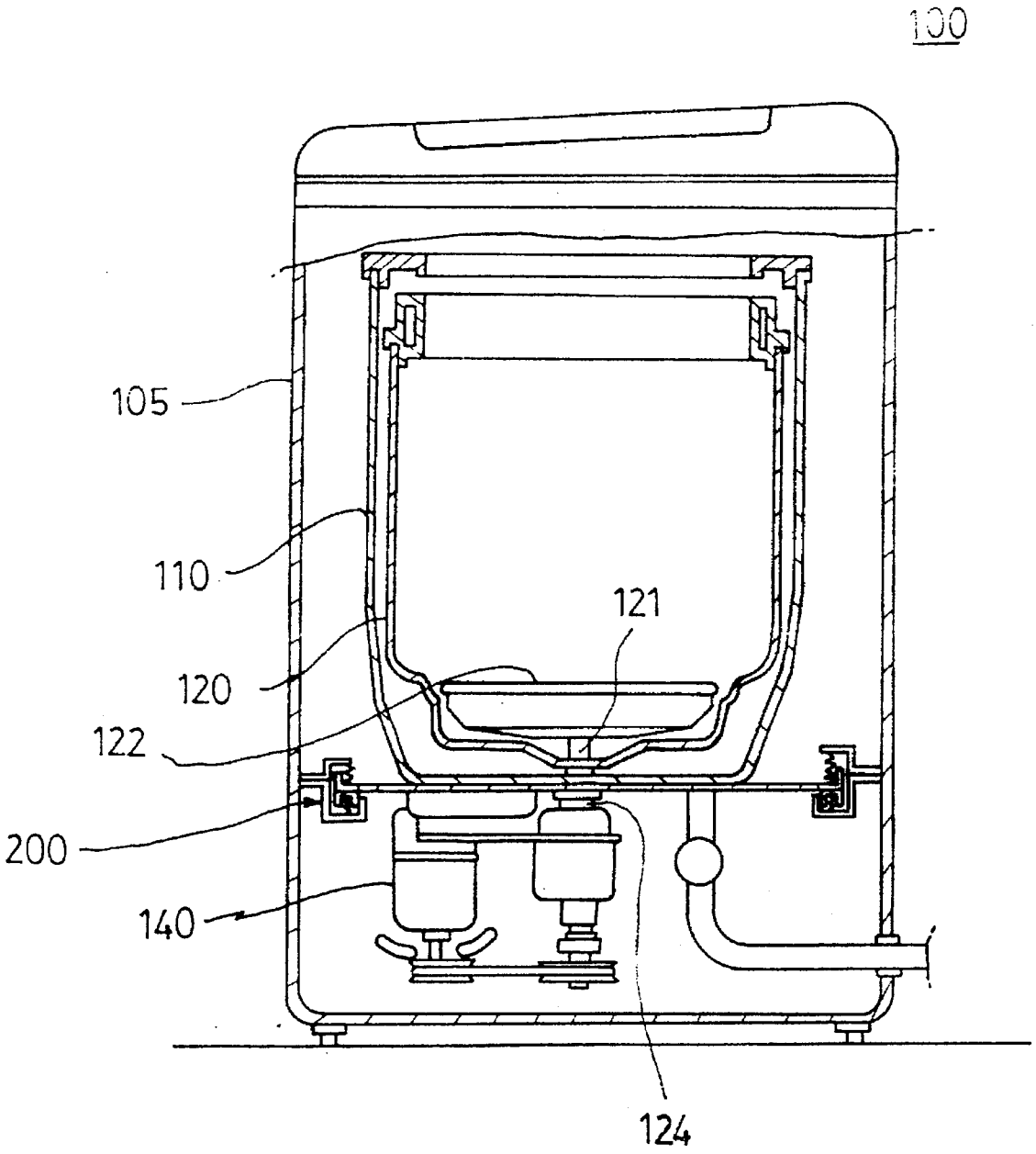
FIG. 1 is a sectional view of a full-automatic washing machine having a vibration damping assembly according to one embodiment of the present invention.

FIG. 1 shows a sectional view of a full-automatic washing machine 100 according to one embodiment of the present invention.

As shown in FIG. 1, full-automatic washing machine 100 according to one embodiment of the present invention has a outer tub 110 for receiving washing liquid, a spin tub 120 mounted in outer tub 110 so as to receive washing objects, a motor 140 for driving spin tub 120, and a vibration damping assembly 200 for damping a vibration of washing machine 100.

Figure 2:
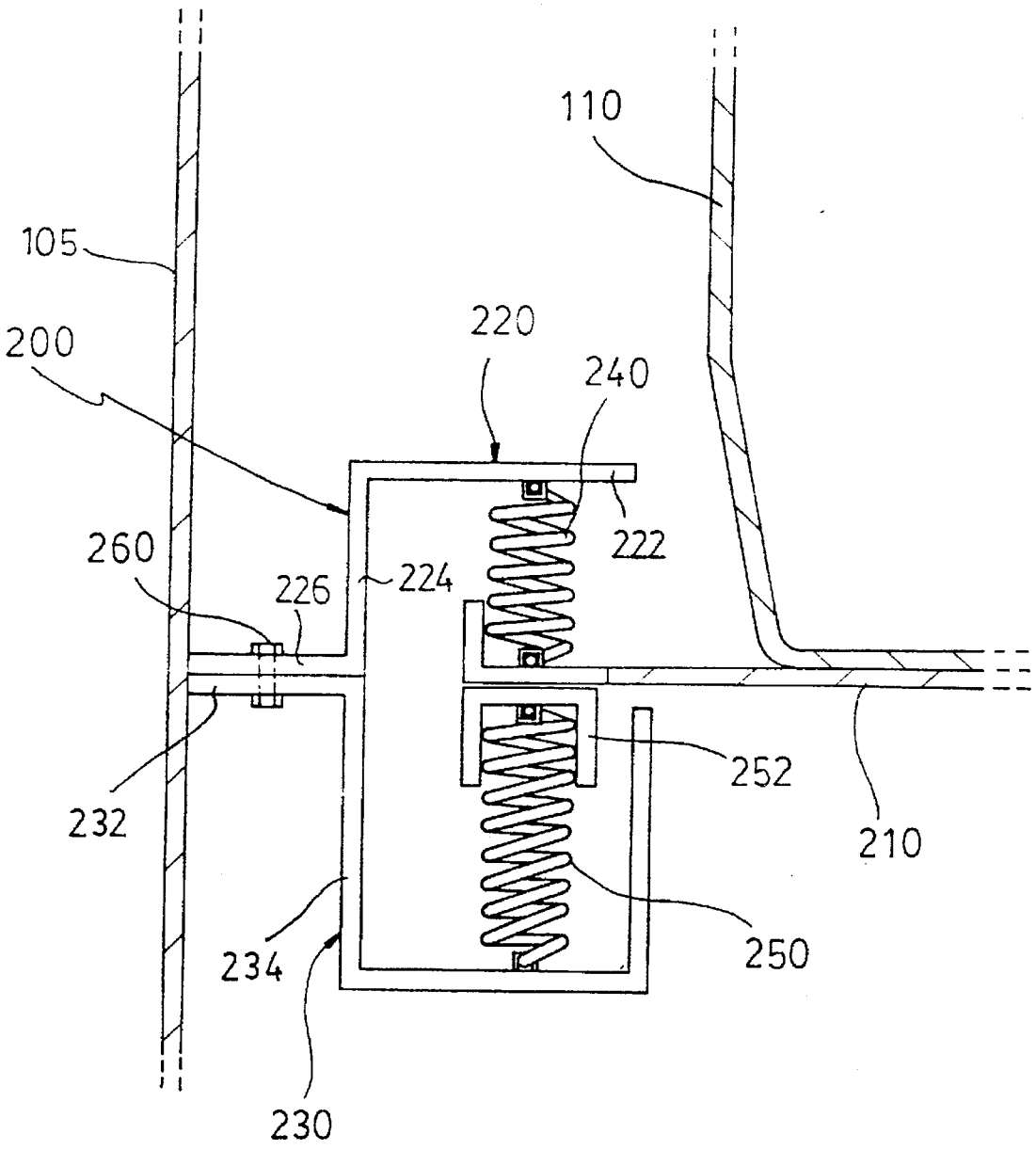
FIG. 2 is an enlarged perspective view of the vibration damping assembly as shown in FIG. 1.
Figure 3:
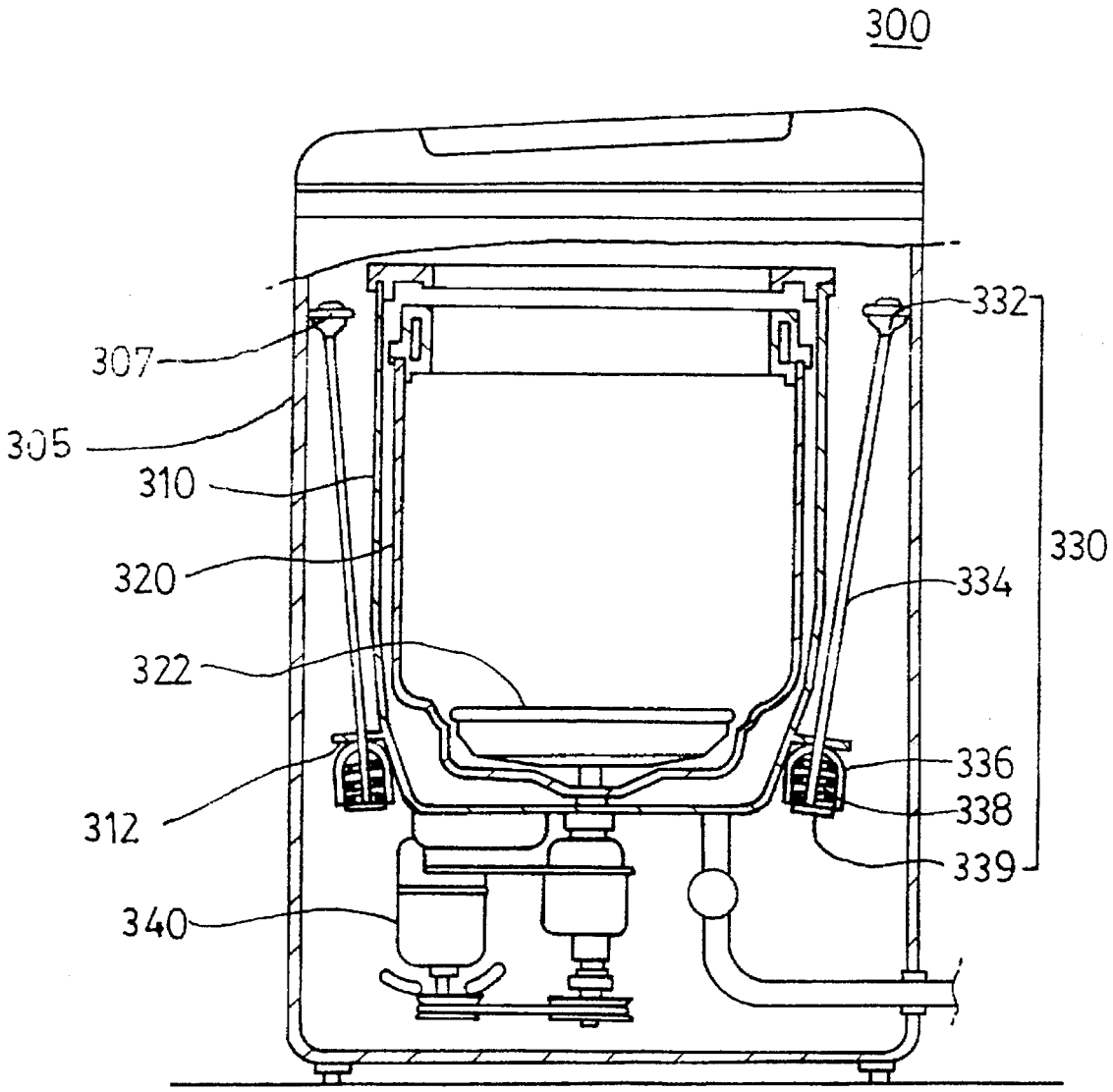
FIG. 3 is a sectional view of a conventional full-automatic washing machine having a vibration damping assembly.

FIG. 2 shows an enlarged perspective view of vibration damping assembly 200 as shown in FIG. 1. Vibration damping assembly 200 is symmetrically shaped so that a shape, a construction, and function of the right side of vibration damping assembly 200 are same as the left side of vibration damping assembly 200. Accordingly, the right side of vibration damping assembly 200 will not be further described hereinafter.

As shown in FIG. 2, in detail, vibration damping assembly 200 includes a base plate 210 formed integrally with an underside of outer tub 110, a bended plate 220 extended above an end of base plate 210, a bucket 230 disposed below base plate 210, a first spring 240 disposed between the end of base plate and bended plate 220, and a second spring 250 accommodated in bucket 230 so as to elastically support base plate 210.

Both ends of base plate 210 are bended upwards at a predetermined distance so as to stably support first spring 240.

Bucket 230 is formed integrally with a lower portion of a body 105 of washing 100, and includes a strip portion 232 and a cylindrical body portion 234. Cylindrical body portion 234 of bucket 230 is spaced out from the underside of base plate 210 at a predetermined distance so as to allow an elastic movement of base plate 210.

Bended plate 220 has a stepped shape, and includes an upper portion 222 disposed above base plate 210 and extended transversely therefrom so as to support first spring 240, a lower portion 226 contacted with strip portion 232 of bucket 230 and secured thereto by a bolt 260, and an upright portion 224 disposed between upper portion 222 and lower portion 226 of bended plate 220.

In addition, at an upper portion of second spring 250, there is provided a spring cap 252 so as to easily support outer tub 110, which is forced to downwards due to weight of washing objects loaded in spin tub 120.

On the other hand, though only one vibration damping assembly 200 is shown in FIG. 2, full-automatic washing machines according to other embodiments of the present invention can be provided with more than two vibration damping assemblies.

Full-automatic washing machine 100 being constructed as described above according to one embodiment of the present invention is operated as follows.

Firstly, in the event of a washing operation, when a user pushes an operating button (not shown) disposed in an upper portion of washing machine 100 on, a control unit (such as micro computer) generates a signal for washing operation, and thereby motor 140 is driven. At this time, the driving force of motor 140 is transmitted to pulsator driving shaft 121 so that a pulsator 122 disposed in a lower portion of spin tub 120 is rotated in a reciprocating motion. As pulsator 122 rotates, a liquid flow having a swirl shape is generated in spin tub 120. The swirl shaped liquid flow that has been generated in spin tub 120 impacts on washing objects, which have been loaded in spin tub 120, and thereby the washing objects are washed.

Then, when the washing operation has finished, washing liquid that has been supplied to outer tub 110 is drained into an exterior of washing machine 100. In this state, the control unit generates a signal for dehydrating operation, and thereby motor 140 is driven again. At this time, the driving force of motor 140 is transmitted to spin tub driving shaft 124 so that spin tub 120 is rotated.

As spin tub 120 rotates, the washing objects loaded in spin tub 120 are subjected to centrifugal force so that the washing objects are forced radially outward of spin tub 120, i.e., toward a side wall of spin tub 120, and thereby washing liquid contained in the washed washing objects is drained into an exterior of washing machine 100 through a plurality of openings formed in the side wall of spin tub 120.

As same as the conventional full-automatic washing, since spin tub 320 having a relatively large size is rotated at a high speed, a vibration is inevitably happened in washing machine 100 during the washing and dehydrating operations.

To reduce the vibration, washing machine 100 of the present invention comprises a vibration damping assembly 200. Vibration damping assembly 200 is disposed in the vicinity of the underside of outer tub 110 in such a manner that vibration damping assembly 200 can support outer tub 110 and can effectively damp the vibration caused by high-speed rotation of spin tub 120.

That is, when a vibration is generated by rotation of spin tub 120 or pulsator 122, the vibration is transmitted to base plate 210 of vibration damping assembly 200, which is formed integrally with the underside of outer tub 110, through outer tub 110. At this time, base plate 210 is elastically moved up and down by elastic vibration of first and second springs 240 and 250, which are connected to an upper side and underside of base plate 210 respectively. As base plate 210 elastically moves up and down, the vibration transmitted to base plate 210 can be damped. The damped vibration is transmitted to the lower portion of body 105 of washing machine 100 through bended plate 220 and bucket 230, which are connected to first and second springs 240 and 250.

In this manner, a reduced vibration is transmitted to body 105 of washing machine 100 so that washing machine 100 may stably carry out the washing and dehydrating operations without making a shake of washing machine 100.

On the other hand, as described above, since second spring 250 disposed in bucket 230 elastically supports outer tub 110, which is forced to downwards due to weight of washing objects loaded in spin tub 120, an extreme vibration does not occur even when the washing objects are non-uniformly distributed within spin tub 120.

As mentioned above, the vibration damping assembly of the present invention has a simple construction so that it may be easily assembled into the washing machine, and moreover, manufacturing cost is reduced.

Further, since the washing machine disperses the vibration to the lower portion of the body of the washing machine, the washing machine can stably carry out the washing and dehydrating operations.

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. A full-automatic washing machine comprising:

an outer tub for receiving supplied washing liquid;

a spin tub mounted in the outer tub so as to receive washing objects;

a motor for driving the spin tub; and a vibration damping assembly including a base plate disposed below the outer tub so as to receive a vibration from the outer tub, a bended plate extended transversely above an end of the base plate, a bucket disposed below the base plate and formed integrally with the body of the washing machine, a first spring disposed between the end of the base plate and the bended plate, and a second spring disposed in the bucket so as to elastically support the base plate, the vibration damping assembly damping a vibration caused by high speed rotation of the spin tub and then dispersing the vibration to a lower portion of a body of the washing machine.

2. The full-automatic washing machine as claimed in claim 1, wherein the base plate is formed integrally with the underside of the outer tub.

3. The full-automatic washing machine as claimed in claim 2, wherein the ends of the base plate are bended upwards at a predetermined distance so as to stably support the first spring.

4. The full-automatic washing machine as claimed in claim 1, wherein the bucket includes a strip portion formed integrally with the lower portion of the body of the washing machine and a cylindrical body portion accommodating the second spring, an upper portion of the cylindrical body portion of the bucket is spaced out from the underside of the base plate at a predetermined distance so as to allow an elastic movement of the base plate.

5. The full-automatic washing machine as claimed in claim 4, wherein the bended plate has a stepped shape, and includes an upper portion disposed above the base plate and extended transversely so as to support the first spring a lower portion contacted with the strip portion of the bucket and secured thereto by a bolt, and an upright portion disposed between the upper portion and the lower portion of the bended plate.

6. The full-automatic washing machine as claimed in claim 1, further comprising a spring cap disposed an upper portion of the second spring, the spring cap being in contact with the underside of the base plate.

7. The full-automatic washing machine as claimed in claim 1, wherein the washing machine has more than two vibration damping assemblies.

8. A full-automatic washing machine comprising:

an outer tub for receiving supplied washing liquid;

a spin tub mounted in the outer tub so as to receive washing objects;

a motor for driving the spin tub; and a vibration damping assembly disposed in the vicinity of an underside of the outer tub for elastically supporting the outer tub, the vibration damping assembly damping a vibration caused by high-speed rotation of the spin tub and then dispersing the vibration to a lower portion of a body of the washing machine, the vibration damping assembly having a base plate formed integrally with the underside of the outer tub so as to receive a vibration from the outer tub, a bended plate extended transversely above an end of the base plate, a bucket disposed below the base plate and formed integrally with the body of the washing machine, a first spring disposed between the end of the base plate and the bended plate, a second spring disposed in the bucket so as to elastically support the base plate and a spring cap mounted to an upper portion of the second spring, the ends of the base plate being bended upwards at a predetermined distance so as to stably support the first spring, the bucket including a strip portion formed integrally with a lower portion of the body of the washing machine and a cylindrical body portion accommodating the second spring, an upper portion of the cylindrical body portion of the bucket being spaced out from the underside of the base plate at a predetermined distance so as to allow an elastic movement of the base plate, the bended plate having a stepped shape and including an upper portion disposed above the base plate and extended transversely so as to support the first spring, a lower portion contacted with the strip portion of the bucket and secured thereto by a bolt, and an upright portion disposed between the upper portion and the lower portion of the bended plate.

* * * * *